United States Patent [19]

Stahlecker

[11] Patent Number: 4,745,738

[45] Date of Patent: May 24, 1988

[54] CLEANING ARRANGEMENT FOR OPEN-END FRICTION SPINNING MACHINE

[76] Inventor: Fritz Stahlecker, Josef-Neidhart-Strasse 18, 7347 Bad Überkingen, Fed. Rep. of Germany

[21] Appl. No.: 6,280

[22] Filed: Jan. 20, 1987

Related U.S. Application Data

[63] Continuation of Ser. No. 838,431, Mar. 10, 1986, abandoned, which is a continuation of Ser. No. 677,465, Dec. 3, 1984, abandoned.

[30] Foreign Application Priority Data

Dec. 1, 1983 [DE] Fed. Rep. of Germany ..... 3343483

[51] Int. Cl.[4] ..... D01H 7/885

[52] U.S. Cl. ..... 57/301; 57/304; 57/401

[58] Field of Search ..... 57/300, 301, 304, 400, 57/401, 302, 306; 19/97, 107, 112, 262, 263, 264

[56] References Cited

U.S. PATENT DOCUMENTS

| | | | |
|---|---|---|---|
| 3,101,504 | 8/1963 | Gasser | 19/262 X |
| 4,038,812 | 8/1977 | Stahlecker | 57/301 |
| 4,074,391 | 2/1978 | Jenkins et al. | 19/107 |
| 4,171,552 | 10/1979 | Leifeld | 19/262 X |
| 4,202,163 | 5/1980 | Turk et al. | 57/401 |
| 4,222,224 | 9/1980 | Raasch | 57/301 X |
| 4,380,892 | 4/1983 | Parker et al. | 57/401 |
| 4,514,973 | 5/1985 | Stahlecker | 57/301 |

FOREIGN PATENT DOCUMENTS

| | | | |
|---|---|---|---|
| 52412 | 5/1982 | European Pat. Off. . | |
| 901035 | 7/1949 | Fed. Rep. of Germany | 19/262 |
| 1571 | 1/1972 | Japan | 19/263 |

*Primary Examiner*—Stuart S. Levy
*Assistant Examiner*—Joseph J. Hail, III
*Attorney, Agent, or Firm*—Barnes & Thornburg

[57] ABSTRACT

An open end friction spinning apparatus is provided in which there are one or more spinning units with respectively two adjacently arranged rollers, rotating in the same direction, and disposed to form a wedge-shaped slot therebetween for accepting fibers and spinning them into a thread of yarn by a friction effect. Mechanical cleaning devices are provided for cleaning the surfaces of the rollers.

22 Claims, 1 Drawing Sheet

CLEANING ARRANGEMENT FOR OPEN-END FRICTION SPINNING MACHINE

BACKGROUND AND SUMMARY OF THE INVENTION

This is a continuation of application Ser. No. 838,431, filed Mar. 10, 1986, which is a continuation of application Ser. No. 677,465, filed Dec. 3, 1984 both of which are now abandoned.

This invention relates to an open-end friction spinning machine having a plurality of spinning units, each containing two rollers that are arranged next to one another. The rollers are drivable in the same rotational direction and form a wedge-shaped gap serving as a yarn forming point.

In the case of a machine for open-end friction spinning contaning only a single spinning unit, it is known (EP-OE No. 52 412) to dispose the two rollers in such a way that one roller can be moved away from the other roller. The wedge shaped gap formed by the rollers is then accessible for manual cleaning. The cleaning could therefore take place only when the spinning process was interrupted and was also dependent on the carefulness of the operating person. In addition, the cost of reconstruction of the bearing of the rollers is very high because these rollers must be disposed in such a way that in the operational position they very precisely maintain their position relative to one another. In order to meet this requirement, even when one of the rollers is to be moved relative to the other roller, very precise tolerances must exist with respect to the guides for this roller.

One objective of this invention is to allow cleaning of the rollers of spinning units without depending on the carefulness of the operating person and at the same time to eliminate the high costs of reconstruction of the bearings of the rollers.

This objective is achieved by providing mechanical cleaning means which are positioned adjacent the surfaces of the rollers in areas outside the wedge-shaped gap.

As a result of the mounting of the mechanical cleaning means, cleaning is no longer dependent on the carefulness of the operating personnel. It is also not critical in this case how the bearings are disposed. In addition, there is the special advantage that the cleaning can be carried out continuously or discontinuously without having to interrupt the spinning operation at the spinning units.

In a further development of the invention, the mechanical cleaning means are arranged in a stationary manner in the spinning units and the cleaning means act constantly so that a constant cleaning of the rollers takes place. As a result, build up of deposits on the surfaces of the rollers is avoided. Such build up may lead to a clogging of the perforations of the rollers, which may in turn cause changes in the friction effect of the rollers leading to corresponding changes in yarn quality.

It is contemplated that the mechanical cleaning means may be constantly biased against the surfaces of the rollers. This results in a continuous cleaning at the cost of a slightly increased power consumption with respect to the drive of the rollers.

It is also contemplated that the mechanical cleaning means can be arranged at a predetermined distance to the surfaces of the rollers. However, these non-contact cleaning means affect only coarser build-up such as neps or fiber deposits, which may collect in the perforations of the surfaces of the rollers.

It is further contemplated that the cleaning means be held so that they can be adjusted relative to the surfaces of the rollers and then an adjusting device is provided for applying the cleaning means to the surfaces of the rollers. By means of this adjusting device, cleaning of the surfaces of the rollers is carried out at predetermined distances while the spinning operation is not interrupted. This may, for example, take place by central actuation of the adjusting device simultaneously at all spinning units of one machine. However, it is also possible to design the adjusting device in such a way that it may, for example, be actuated by a servicing apparatus moving along the spinning machine.

In a further development of the invention, at least one suction device for removing the detached build up or deposits is provided for the mechanical cleaning means at each spinning unit. This prevents the accumulation of removed build up in the area of the rollers. The suction device may be designed so that it operates continuously or only periodically at predetermined intervals.

Further objects, features, and advantages of the present invention will become more apparent from the following description when taken with the accompanying drawings which show, for purposes of illustration only, embodiments in accordance with the present invention.

DETAILED DESCRIPTION OF THE DRAWINGS

Figure 1:
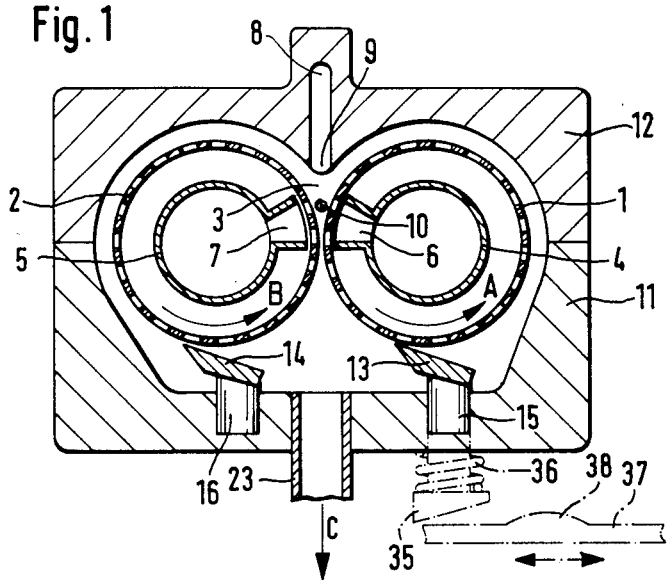
FIG. 1 is a cross-section through a spinning unit of an open-end friction spinning machine having stripping elements arranged in the area of the rollers and mounted at a distance to the surfaces of the rollers, constructed in accordance with a preferred embodiment of the invention.
Figure 2:
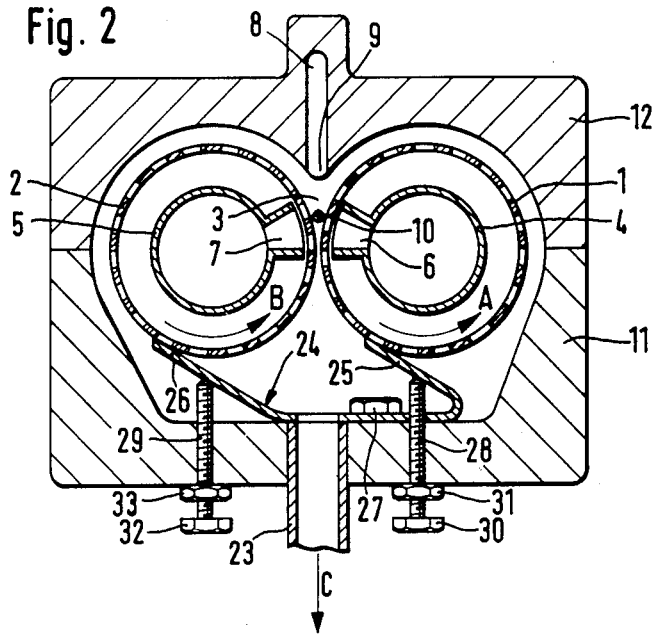
FIG. 2 is a cross-section similar to that in FIG. 1 wherein stripping elements are provided which are biased against the surfaces of the rollers, constructed in accordance with another preferred embodiment of the invention.

In the case of an open-end friction spinning machine, a plurality of individual spinning units corresponding to FIGS. 1 and 2 are arranged next to one another, preferably on each side of the machine. Each of the spinning units contains two rollers 1 and 2 which are arranged parallel to one another in such a way that they form a narrow wedge-shaped gap 3. The surfaces of the rollers 1 and 2 are perforated. Suction inserts 4 and 5 are provided with suction slots 6 and 7 aimed at the area of the wedge-shaped gap 3. The suction slots 6 and 7 are delimited by webs that are led close to the inferior surfaces of the rollers 1 and 2. The suction pipes, in a manner that is not shown in detail, are connected to a vacuum source producing an air current which flows into the area of the wedge-shaped gap 3, through the perforations in the rollers 1 and 2 and into the suction slots 6 and 7 of the suction inserts 4 and 5.

Mouth 9 of the fiber feeding channel 8 which leads individual fibers from a feeding and opening device (not shown) to the wedge-shaped gap 3 is disposed opposite said gap. The air current produced by the suction inserts 4 and 5 effects the transport of fibers to the wedge-shaped gap 3 and keeps the forming yarn 10 in the tapering area of the wedge-shaped gap 3. The two rollers 1 and 2 are driven in the same rotational direction indicated by arrows A and B so that, by means of the fricton effect, fibers are twisted together into yarn 10. The yarn is withdrawn longitudinally along the wedge-shaped gap 3 by a withdrawal device in a manner not shown.

The fiber feeding channel 8 and its mouth are located in a partial housing 12 which is provided with other openings in the area of the wedge-shaped gap 3, in a manner that is not shown in detail. In addition, the partial housing 12 covers portions of the surfaces of rollers 1 and 2 that form the wedge-shaped gap 3. The rear side of the rollers 1 and 2 is covered by a partial housing 11 in which the bearings of the rollers 1 and 2 are housed in a manner that is not shown in detail. Preferably, the cylindrical rollers 1 and 2, by means of roller bearings, are disposed directly on the tube-shaped suction inserts 4 and 5 which themselves are fastened in a stationary manner in predetermined positions to the partial housing 11.

A blade-type stripping element 13 and 14 is assigned to each roller 1 and 2 (FIG. 1). The stripping element 13 and 14 extends at least along the area that corresponds to the position of the slot-shaped mouth 9 of the fiber feeding channel 8 which extends longitudinally along the wedge-shaped gap 3. The blade-shaped stripping elements 13 and 14 are held rigidly in the partial housing 11 by means of several fastening bolts 15 and 16 in such a way that their cutting sides are arranged at a short distance from the surfaces of the rollers 1 and 2. The blade-type stripping elements 13 and 14 are aligned approximately tangentially to the surfaces of the rollers 1 and 2.

In the area between the rollers opposite the wedge-shaped gap 3, a suction pipe 23 is connected in the partial housing 11. By means of the pipe, build up and deposits detached from the rollers 1 and 2 by the stripping elements 13 and 14 are drawn off continuously or at predetermined time intervals.

In the case of the spinning units according to FIG. 2 which in its basic structure corresponds to the spinning unit according to FIG. 1, a U-shaped component 24 made of elastic material exhibiting spring-like properties is fastened to the partial housing 11 by means of screws 27. The component 24 has two legs 25 and 26 serving as the stripping elements. These legs are equipped with blade-type edges which rest tangentially against the surfaces of these rollers and extend in a direction opposite the direction of rotation of the rollers at the point of tangency. Also in this case, the legs 25 and 26 extend at least along the yarn formation zone of the rollers 1 and 2, i.e., at least along the length of the mouth 9 of the fiber feeding channel extending in the region of the wedge-shaped gap 3.

The component 24 has an opening for the suction pipe 23 so that the detached build up and deposits can be led away.

In order to be able to adjust the spring tension causing the biasing of the legs 25 and 26 against the surfaces of the rollers 1 and 2, at least one adjusting screw 28 and 29 is provided for each of the legs 25 and 26, by means of which the legs 25 and 26, with a certain tension, contact the surfaces of the rollers 1 and 2. The adjusting screws 28 and 29 provided with a head 30 and 32 are inserted into threaded bores of the partial housing 11 and by means of counternuts 31 and 33, are secured in the adjusted position. The length of the legs 25 and 26 is selected to be such that their blade-type edges rest against the surfaces of the rollers 1 and 2.

By dashed lines, a modification is shown in FIG. 1 in the form of stripping element 13 by which a periodic cleaning effect, instead of a continuous cleaning effect, can be achieved. The bolts 15 of the stripping element 13 extend toward the outside and are provided with a limit stop 35. Between the limit stop 35 and the partial housing 11, a spring 36 is provided which pulls the bolts 15 and thus the stripping element 13 away from the surface of the roller 1. The limit stop 35 is provided with a diagonal stopping surface. A cam 38 of a rod 37 is provided that can be moved transversely to the head 35. When the rod 37 is shifted in the direction of the limit stop 35, the cam 38 presses the bolt 15 into the partial housing 11 and thus presses the stripping element 3 against the surfaces of the roller 1. It is further contemplated that the stripping element 14 be designed similarly and can be actuated correspondingly by the rod 37 provided with another cam. The shifting of the rod 37 can be caused by a central drive of the spinning machine, in which case all rollers 1 and 2 of the spinning units are cleaned simultaneously after a predetermined time interval. But it may also be provided that the rod 37 is actuated by a servicing carriage that can be moved along the spinning machines so that, when required, a cleaning of the rollers takes place simply by an actuation of the servicing carriage.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Open-end friction spinning apparatus comprising:

at least one pair of friction roller surfaces on which yarn is formed defining a substantially linear yarn forming region therebetween;

means for withdrawing said formed yarn along said substantially linear yarn forming region; and cleaning means for cleaning at least one of the pair of friction roller surfaces, said cleaning means mechanically contacting at least a portion of the surface of at least one of the pair of friction roller surfaces during normal yarn formation on and withdrawal from said friction roller surfaces during a cleaning operation.

2. Apparatus according to claim 1, wherein said cleaning means are mounted in a stationary manner in said friction spinning apparatus.

3. Apparatus according to claim 1, including means for biasing said cleaning means against said friction roller surfaces.

4. Apparatus according to claim 1, wherein said cleaning means are positioned at a predetermined distance from said surfaces of said rollers and including means for moving said cleaning means into contact with at least a portion of the surface of at least one of the pair of friction roller surfaces during said cleaning operation.

5. Apparatus according to claim 1, wherein said cleaning means are selectively engagable with at least a portion of the surface of at least one of the pair of friction roller surfaces during said cleaning operation.

6. Apparatus according to claim 5, further comprising engaging means for engaging said cleaning means with at least a portion of the surface of at least one of the pair of friction roller surfaces during said cleaning operation.

7. Apparatus according to claim 6, wherein said engaging means comprise cam means.

8. Apparatus according to claim 7, wherein said cam means are activated by a central drive means of said spinning apparatus.

9. Apparatus according to claim 1, further comprising suction means adjacent said mechanically contacting cleaning means for removing deposits detached from said rollers by said mechanically contacting cleaning means.

10. Apparatus according to claim 1, wherein said cleaning means comprise stripping means extending longitudinally along said surface of said at least one of the pair of friction roller surfaces.

11. Apparatus according to claim 10, wherein said stripping means are mounted to extend substantially tangentially with respect to said surfaces of said rollers.

12. Apparatus according to claim 10, wherein said stripping means are provided with sharp edges.

13. Apparatus according to claim 10, including means for biasing said stripping means against said surfaces of said rollers.

14. Apparatus according to claim 12, including means for biasing said stripping elements having sharp edges against said surfaces of said rollers.

15. Apparatus according to claim 13, further comprising adjusting means for adjusting said bias of said stripping means.

16. Apparatus according to claim 1, wherein said cleaning means are in constant physical contact with said surfaces of said rollers.

17. Apparatus according to claim 1, wherein said at least one pair of friction roller surfaces form a wedge-shaped yarn forming gap therebetween.

18. Apparatus according to claim 17, wherein a fiber feeding channel is provided for supplying fibers to the wedge-shaped yarn forming gap, said fiber feeding channel including a slot-shaped mouth which extends longitudinally along the wedge-shaped yarn forming gap, and wherein said cleaning means include stripper elements engageable with at least one of the friction rollers along a length corresponding to the length of the slot-shaped mouth of the fiber feeding channel.

19. Apparatus as in claim 1, wherein said cleaning means are configured to physically contact said friction surface means at a location spaced from the yarn forming region during said cleaning operation.

20. Apparatus according to claim 1, including housing means surrounding said at least one pair of friction roller surfaces and yarn forming region, said cleaning means being fastened to an inside portion of said housing means.

21. Apparatus according to claim 20, including adjusting screw means passing through bores in said housing means, said adjusting screw means having a first end in contact with said cleaning means and a second end extending outside of said housing means, said adjusting means being selectively movable from outside said housing to effect a preselected separation between said cleaning means and said at least one pair of friction roller surfaces.

22. Apparatus for open-end friction spinning comprising:

a plurality of spinning units, each said spinning unit containing at least one drivable spinning surface rotatable about an axis of rotation, said spinning surface defining a yarn formation zone along a line adjacent said surface, said axis of rotation and said line being substantially coplanar;

mechanical cleaning means for cleaning said spinning surface, said cleaning means being selectively engagable with said surface at a position outside said yarn formation zone, said cleaning means being capable of cleaning said spinning surface while yarn is being formed in said yarn formation zone;

housing means surrounding said spinning surface and said yarn formation zone, said mechanical cleaning means being fastened to an inside portion of said housing means; and adjusting screw means passing through bores in said housing means, said adjusting screw means having a first end in contact with said cleaning means and a second end extending outside of said housing means, said adjusting means being selectively movable from outside said housing to effect a preselected separation between said cleaning means and said spinning surface.

* * * * *